US005146881A

United States Patent [19]

Pfefferle

[11] Patent Number: 5,146,881

[45] Date of Patent: * Sep. 15, 1992

[54] METHOD OF OPERATING I.C. ENGINES AND APPARATUS THEREOF

[76] Inventor: William C. Pfefferle, 51 Woodland Dr., Middletown, N.J. 07748

[ * ] Notice: The portion of the term of this patent subsequent to Jan. 30, 2007 has been disclaimed.

[21] Appl. No.: 730,959

[22] PCT Filed: Feb. 15, 1990

[86] PCT No.: PCT/US90/00860

§ 371 Date: Jul. 19, 1991

§ 102(e) Date: Jul. 19, 1991

Related U.S. Application Data

[63] Continuation-in-part of Ser. No. 311,848, Feb. 17, 1989, Pat. No. 4,896,636.

[51] Int. Cl.[5] ..... F02P 19/00; F02P 23/02

[52] U.S. Cl. ..... 123/145 A; 123/179.6; 219/270; 431/268

[58] Field of Search ..... 123/143 B, 145 A, 179 BG, 123/179 H, 670; 60/39.822; 431/262, 268; 219/270

[56] References Cited

U.S. PATENT DOCUMENTS

| | | | |
|---|---|---|---|
| 4,345,555 | 8/1982 | Oshima et al. | 123/145 A X |
| 4,658,772 | 4/1987 | Auth et al. | 123/145 A |
| 4,896,636 | 1/1990 | Pfefferle | 123/145 A |

FOREIGN PATENT DOCUMENTS

| | | | |
|---|---|---|---|
| 01093 | 3/1983 | PCT Int'l Appl. | 123/145 A |

*Primary Examiner*—Tony M. Argenbright
*Attorney, Agent, or Firm*—Kane, Dalsimer, Sullivan, Kurucz, Levy, Eisele and Richard

[57] ABSTRACT

Operation of unthrottled internal combustion engines is improved by providing the combustion chambers with an electrically heated glow plug having a catalyst surface layer on the ignition element. The catalyst is heated to and maintained at a temperature high enough to be effective for vaporization of fuel drops and ignition of vaporized fuel by controlled electrical heating. In operation of the engine air is compressed in a combustion chamber and at least a portion of the fuel is injected during the latter portion of the compression stroke and the injected fuel ignited by contact of fuel with the hot catalytic surface of the glow plug resulting in a combustion pressure wave in the immediate vicinity of top dead center.

2 Claims, 2 Drawing Sheets

METHOD OF OPERATING I.C. ENGINES AND APPARATUS THEREOF

This application is a Continuation-in-part of application Ser. No. 311,848, filed Feb. 17, 1989, now U.S. Pat. No. 4,896,636.

BACKGROUND OF THE INVENTION

1. Field of the Invention

This invention relates to an improved method of operating unthrottled internal combustion engines at compression ratios lower than required for diesel engines. Moreover, this invention relates to means for operating glow plugs in unthrottled engines at lower plug temperatures than would be required with non-catalytic glow plugs of the same size and geometry. In one specific embodiment, the plug temperature is provided with temperature determining means and electrical power is controlled to maintain the plug walls at a value determined by the engine speed and power output.

This invention also relates to catalytic glow plugs capable of igniting fuels at lower temperatures than a non-catalytic glow plug of the same size and shape.

2. Brief Description of the Prior Art

Existing diesel engines achieve a significantly higher thermal efficiency than conventional gasoline engines in automotive use and emit acceptable levels of carbon monoxide and light hydrocarbons. However, soot and nitrogen oxide levels are high and compression ratios are much higher than the optimum for maximum fuel economy. Moreover diesels are relatively hard to start as compared to automotive gasoline engines, even with electrically heated glow plugs, and require high cetane fuels. This is especially true of the lower compression diesels such as the large lower speed engines. With use of glow plugs, short plug life can be a problem particularly under operating conditions which require higher plug operating temperatures, such as cold starting at arctic temperatures.

As a means of improving cold starting performance of conventional high compression diesel engines with glow plugs, the use of catalytically self-heating glow plugs has been proposed (U.S. Pat. 4,345,555). Such self-heating plugs are said to maintain a preset plug temperature by exothermic catalytic reactions after termination of the initial electrical heating of the plug during starting. A self-heating plug is said to maintain a higher temperature than a non-catalytic diesel glow plug and is further said to maintain a temperature above that required for ignition of fuel by a non-catalytic plug. It is taught that the catalyst should comprise a porous carrier, presumably to achieve greater surface heating (it is well known that such porous supports provide a greater surface area for catalytic reactions than a non-porous support). Self-heating plugs can be expected to offer no improvement in plug life as compared to conventional glow plugs inasmuch as such self-heating plugs are said to maintain a higher temperature than conventional plugs. Plugs which are effective at lower plug temperatures would allow easier starting under adverseconditions and would enable starting lower ambient temperatures.

In addition to the above cited shortcomings, conventional diesels cannot be operated at low enough compression ratios for maximum efficiency and conventional diesels cannot efficiently utilize low cetane fuels such as methanol and gasoline. Although in-cylinder catalysts previously proposed can improve efficiency and reduce emissions of soot and nitrogen oxides, retrofitting of existing engines is not always economically feasible, especially with small automotive diesels.

Conventional spark ignition engines are typically less efficient than diesel engines in spite of operating in close appoximation to the constant volume combustion Otto cycle, a more efficient cycle than the diesel cycle. This lower efficiency is believed to result primarily from the throttling losses associated with the requirement for spark ignition. Spark ignition requires near stoichiometric fuel-air mixtures for flame propagation. To control power levels, the amounts of fuel and air must both be varied in step. This requires throttling of the inlet air with resultant loss of pressure energy. Octane limits of fuels typically limit compression ratios to below optimum levels. Operation of spark engines without throttling of the inlet air could result in an engine more efficient than the diesel, even if such engines were limited to below optimum compression ratios.

Attempts have been made to operate unthrottled engines at lower than diesel compression ratios. With compression ratios too low for autoignition, an ignition source such as a spark plug or a continuously operating glow plug is needed. Thus, stratified charge spark-ignited engines of various designs, both piston and rotary, have been proposed. To date, such engines have not won acceptance. For use with heavy fuels such as diesel and jet A, spark plug fouling has been a severe problem leading to the use of glow plugs. Although use of glow plugs eliminates the fouling problem, a higher glow plug temperature is required for operating a low compression ratio engine than for cold starting a diesel engine. This is believed to be because the compression temperature of a low compression engine is lower than that of a high compression diesel at typical cold start conditions. Another factor is that the ignition temperature of hydrocarbon fuels may be higher at lower pressures than at higher pressures. With the high continuous operating temperature required using conventional glow plugs in a low compression engine, typically in excess of about 1375 degrees K, plug heat losses must be minimal if plug power requirements are to be acceptable at all operating conditions. With such a low heat loss plug it has been found that not only is no electrical power required at full load operation but that plug temperatures can even exceed the temperature limits of a high temperature material such as silicon nitride. Although much larger plugs could be used to lower operating temperature to some extent, power requirements would be excessive and space might not be available. The capability to ignite fuels at lower compression temperatures has implications for cold starting of conventional diesels. Even with conventional high compression diesels, at low enough ambient temperatures the compression temperature will be as low as in a 10/1 compression ratio engine at the usually prevailing ambient temperatures.

The method of the present invention overcomes the limitations of the prior art by providing glow plugs capable of ignition at a surface temperature as much as 300 degrees Kelvin lower than required for a non-catalytic glow plug of the same size and configuration and by providing an economical means of operating internal combustion engines at lower compression ratios without throttling of the inlet air and the throttling losses associated therewith. Use of the low ignition temperature catalytic glow plugs of the present invention in an internal combustion engine enables quicker starts inasmuch as less time is required to heat a plug to a lower temperature. Equally important, by providing a means of more rapid ignition at a lower plug temperature, combustion efficiency in engines is improved and emissions reduced. It is believed that the lower ignition temperature and more efficient combustion is a consequence of free radical production by the low porosity catalytic ignition surfaces of the present invention. It is known in the art that free radicals are combustion reaction intermediates.

SUMMARY OF THE INVENTION

According to the present invention, an internal combustion engine is fitted with a catalytic glow plug and control means to maintain the catalytic surface of the glow plug at a specified temperature below that required for rapid ignition of fuels with an equivalent geometry non-catalytic conventional glow plug in the same engine. Typically the specified temperature is 50 to 300 degrees Kelvin lower than for an equivalent non-catalytic plug, more preferrably 75 to 150 degrees Kelvin lower but may be as much as 600 degrees Kelvin lower with fuels which are especially reactive catalytically. The catalytic surfaces of the glow plug may comprise a base metal oxide ignition catalyst or a platinum metal catalyst. For best ignition performance, the catalyst surface is of low porosity, preferably substantially nonporous. An essentially nonporous nature of the catalyst surface is advantageous to avoid permeation of fuel into the catalyst which would tend to cool the catalyst on contact with injected fuel droplets. Advantageously, the catalytic surface may be sintered at a temperature higher than the intended maximum operating temperature prior to use.

In operation of the engine, the glow plug is advantageously electrically heated to bring it to the required operating temperature, typically within the range of about 700 degrees Kelvin to about 1400 degrees Kelvin depending on factors such as engine compression ratio, engine speed, inlet air temperature and the fuel composition. Those skilled in the art will appreciate that a specific optimal temperature for operating a specific engine will be dependent upon the above factors, but can be readily determined by trial in the engine. After heating of the plug, the engine is started. Fuel is injected such that at least a portion of the fuel contacts the catalytic surface prior to the time of maximum compression. Electrical power is controlled such that the glow plug is maintained at a temperature appropriate for rapid ignition of the fuel at the given engine operating conditions. With lower compression ratio engines, continued electrical heating is usually needed at the lower power levels. Typically however, no electrical power is required at full engine power operation because heat transfer from the hot combustion gases of fuel combusting at temperatures in excess of 2000 degrees Kelvin is sufficient to heat even a non-catalytic plug to a temperature sufficient for ignition of fuel. Because catalytic oxidation of the fuel on the catalytic glow plug surface results in high concentrations of ignition enhancing free radicals in the adjacent gas, a catalytic glow plug of the present invention requires a lower surface temperature for ignition of fuel and thus less electrical heating than a non-catalytic glow plug for rapid ignition of fuel. Operation of an internal combustion engine in accordance with the present invention offers greater ease in starting and reduced emissions of soot, not only with conventional diesel fuels but also with low cetane fuels such as methanol, ethanol, and other alcohols and oxygenated fuels. Cold starting is made possible even at temperatures below 240K and even as low as 210 or 200K provided the fuel is pumpable and the starting motor can crank the engine. With a glow plug according to the present invention, oxygenated fuels such as methanol ignite even more readily than diesel fuels. This is of considerable importance since it greatly increases the availability of fuels suitable for use in diesel engines and in the more efficient lower compression ratio unthrottled internal compression ratio engines made practical by use of glow plugs of the present invention.

In the present invention, improved ignition of the fuel by virtue of catalytic action is believed to result from surface oxidation of a minor amount of the fuel. It is believed that the catalyst injects radical species into the gas phase, thus lowering the temperature required for gas phase combustion. It is well known that radical species can speed up combustion. Accordingly, for effective ignition according to this invention, the required catalyst temperature is significantly lower than required with a non-catalytic plug thus reducing the amount of electric power required to achieve rapid ignition at low engine power levels in a low compression ratio engine. At full engine power output no electrical power should normally be required. Even at compression ratios lower than required for autoignition, at full engine power combustion temperatures have been found to be high enough to maintain even non-catalytic glow plug surfaces at a temperature high enough for ignition of fuel with no electrical power required.

At surface temperatures below those required for catalytic ignition of the fuel, the presence of a catalyst can even delay gas phase combustion, thus the importance of controlling plug temperature. This result is believed to stem from quenching of radicals generated in the gas phase. It has long been known that such quenching of free radicals is promoted by active catalyst surfaces. It is believed that porous catalytic surfaces are such poor ignition catalysts because the catalyst pores can not only trap fuel but because the pores can trap free radicals long enough for radical recombination, thus the need to minimize catalyst porosity. Conventional high surface area catalysts are particularly ineffective for ignition, even though such catalysts are much more active than nonporous igniters for surface oxidation and surface heating.

Although quenching of radicals has been suggested as a means to inhibit gum formation prior to spark or autoignition, the resulting inhibition of combustion is disadvantageous inasmuch as such inhibition can quench combustion prior to completion resulting in high emissions of hydrocarbons and carbon monoxide. In the present invention the electrical power required may be reduced in low load operation by a pilot injection of fuel immediately preceeding injection of the main fuel charge or alternately by earlier timing of the injection of the fuel charge.

BRIEF DESCRIPTION OF THE DRAWINGS

This invention can be further understood with reference to the drawings in which.

DETAILED DESCRIPTION OF PREFERRED EMBODIMENTS OF THE INVENTION

This invention relates to a method of operating a low compression unthrottled engine wherein fuel and compressed air are contacted with the catalytic ignition surface of a catalytic glow plug maintained by electrical heating at a temperature sufficient for ignition of the fuel, whereby starting of the engine is facilitated and combustion efficiency during operation is improved even with engine compression ratios below 14 to 1 or even with compression ratios below about ten or twelve to one. In one embodiment a catalytic coating is firmly affixed to the surface of a conventional diesel glow plug. In another embodiment the walls of the glow plug tip, ie: ignition element, are formed of a catalytic material, preferrably a catalytic base metal oxide ceramic. In still another embodiment the glow plug is provided with temperature determining means and the electrical power is controlled to maintain the walls of the glow plug above a predetermined temperature. The catalyst typically comprises a base metal oxide or noble metal ignition catalyst. Injection of the fuel is timed such that at least a portion of the fuel contacts the catalyst surface prior to the point of maximum compression.

More specifically, this invention relates to catalytic glow plugs and the means to maintain a glow plug catalytic ignition element at an operational temperature in an unthrottled low compression engine during engine start-up and during operation at less than full load.

Figure 1:
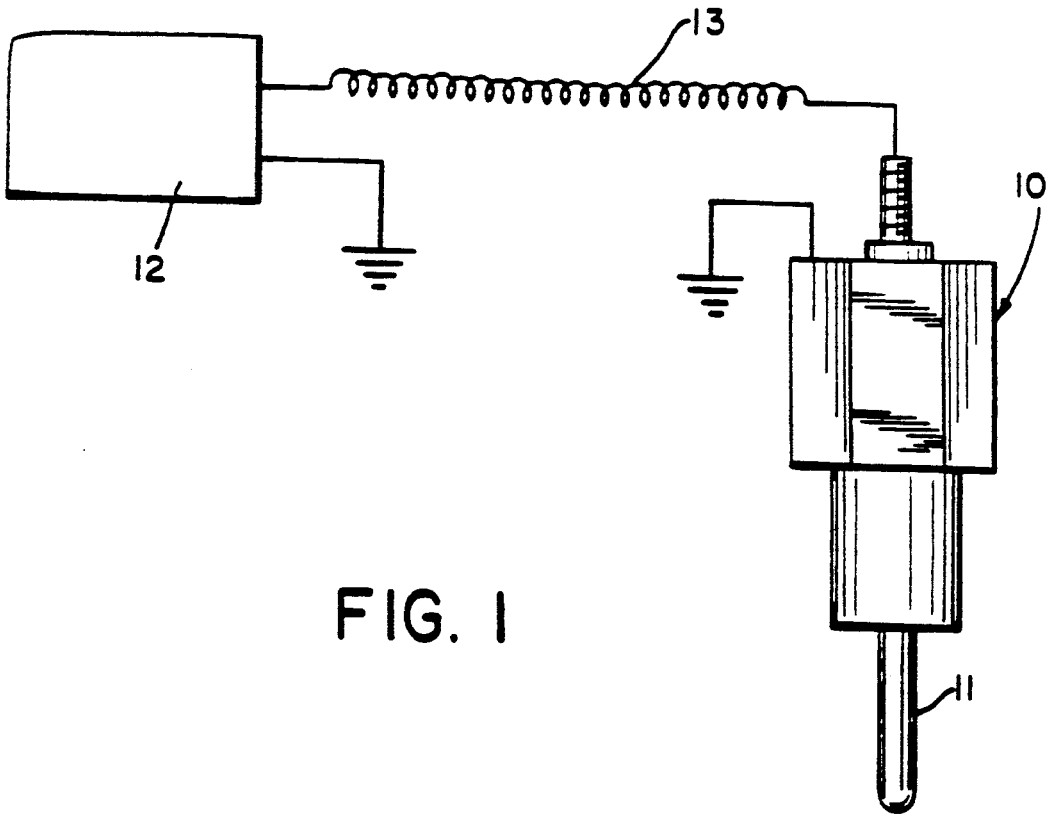
FIG. 1 is a schematic of a system of the present invention.
Figure 2:
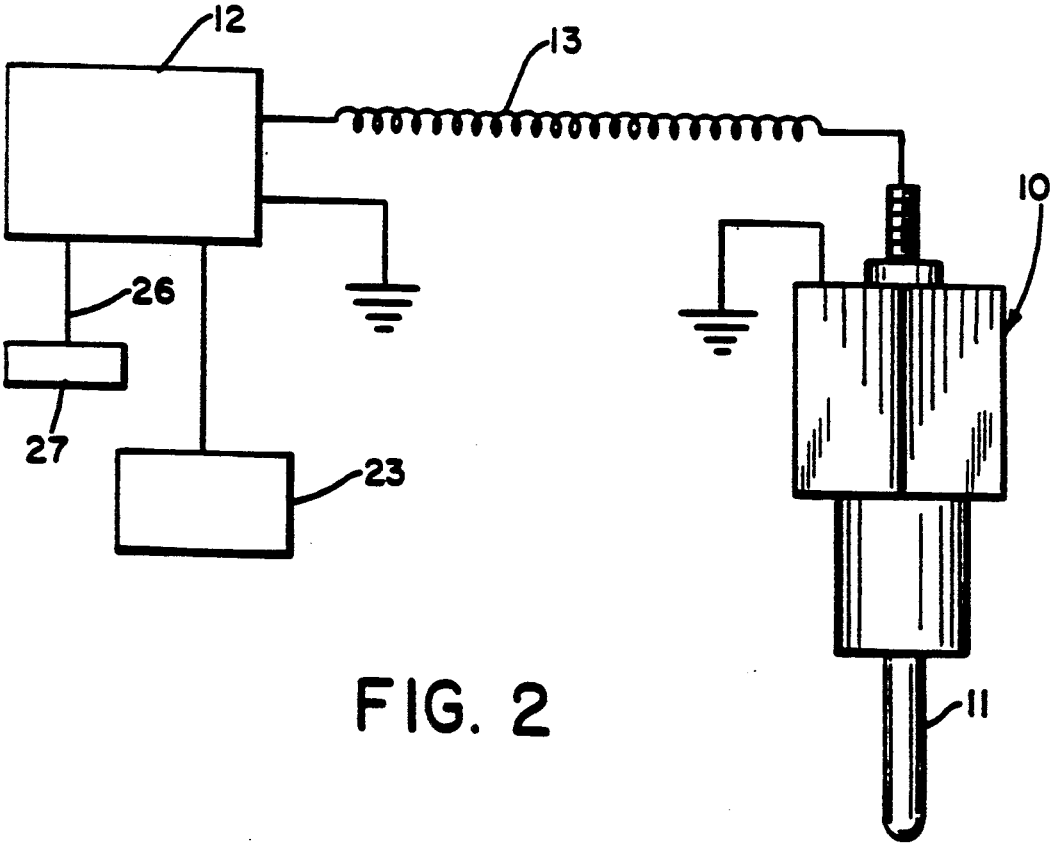
FIG. 2 is a schematic of a predictive control system.

The present invention is further described in connection with the drawings. As shown in FIG. 1, in one preferred embodiment the catalytic system consists of a glow plug 10 having an ignition element (tip) 11 with a nonporous surface comprising an ignition catalyst and temperature control unit 12 which feeds power to plug 10 via line 13. Control unit 12 determines the temperature of the catalytic surface of plug tip 11 by measuring the current and voltage applied to plug 10 and calculating the load resistance which is a function of the temperature of plug tip 11. Control unit 12 is designed to supply electrical power to plug 10 only as needed to maintain a predetermined temperature of tip 11, which advantageously may be a function of engine operating parameters including load, speed, and inlet air temperature. Advantageously, a preferred method is predictive control of the glow plug temperature using a computer. Control unit 12 may be a conventional unit known in the art, as for example such as the Condarcure units available commercially. As shown in FIG. 2, process control computer 22, hereinafter referred to as the predictive controller, is preprogrammed to supply power to glow plug 10 during starting and thereafter to supply power as a function of the power level setting of engine fuel injector pump 23, typically maintaining plug tip 11 at a temperature at least about 75K lower than required at lower power settings of fuel injector pump 23 than would be required for a non-catalytic glow plug. Controller 22 may be connected via line 26 to optional inlet air temperature sensor 27 and programmed to apply increased electrical power at lower inlet air temperatures. During engine operation controller 22 monitors plug catalyst temperature by measurement of the current and voltage applied to plug 10 as described above. The computer 22 is a conventional hardware item commercially available.

Figure 3:
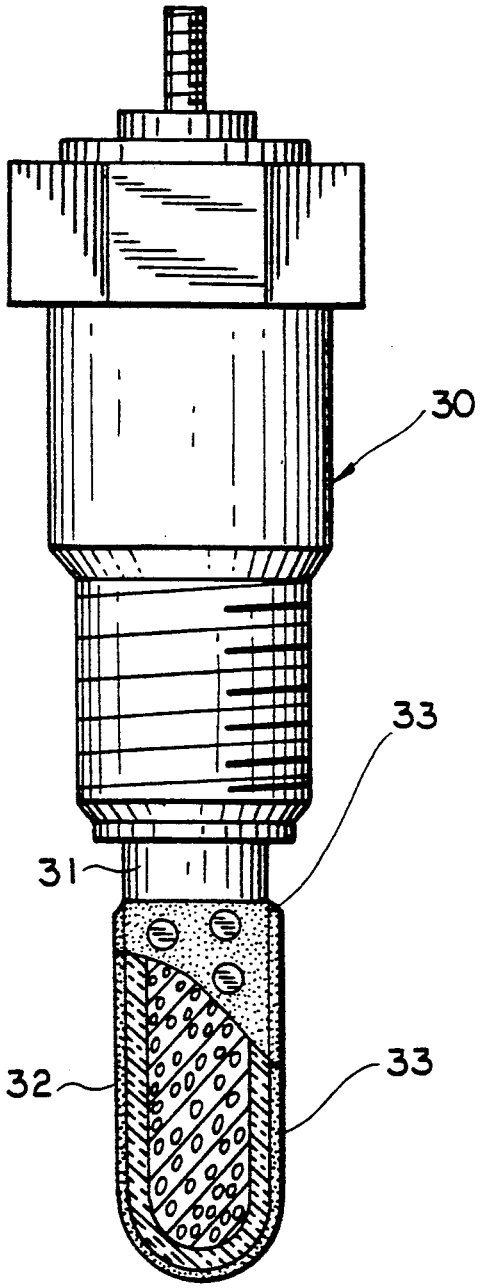
FIG. 3 is a sectional view of a conventional diesel glow plug which has been modified by coating with an ignition catalyst.

FIG. 3 shows an expanded sectional-in-part view of a conventional glow plug 30 to which a coating of a refractory metal oxide 32 has been applied by sputtering to plug tip 31. The metal oxide preferrably has a melting point of at least about 2000K. To maximize thermal shock tolerance and to minimize thermal lag it is preferred that coating 32 be thin, less than 10 mils thick and preferably less than 2 mils or even less than 0.5 mils. Only a minimal thickness is required, as for example 0.0001 mils. Ignition catalyst 33 comprises an overcoating of a portion of the surface of coating 32; preferably a major proportion (at least 51 percent). Suitable ignition catalysts include the low vapor pressure platinum group metals, such as Pt, Pd, Rh and the like; refractory base metal oxide ignition catalysts, such as CoO, NiO, and the like and high temperature stable base metal oxide compounds such as the perovskites. Alternatively, the oxide coating 32 may itself comprise the catalytic surface 33 if a catalytic material is used for coating 32. Methods of applying suitable catalytic coatings are known in the art. Especially advantageous for the purposes of this invention is the ignition catalyst coating and method described in U.S. Pat. No. 4,603,547, incorporated herein by reference thereto.

For enhancement of diesel engine ignition, it is important that the catalytic glow plug be maintained at a temperature at which the catalyst used is effective for ignition of the fuel. In general the plug tip is maintained at a temperature of about 75 to 300 degrees Kelvin lower than that required to start a diesel engine using a conventional glow plug. The required plug temperature is readily determined for any fuel by contacting a flammable fuel air mixture with a heated glow plug. The control means is then readily designed to maintain the catalytic glow plug at a temperature at which the catalyst is effective for rapid ignition. Preferrably, during cold starting of an engine the glow plug is maintained at a temperature at least about 50 degrees Kelvin higher than the desired control temperature during normal operation of the engine. This allows faster start-ups. During normal operation after engine start-up, electrical power need be supplied to the catalytic glow plugs only if the plug temperature falls below the predetermined control temperature. It should be understood that during full load operation of the engine, combustion of fuel in the engine will typically maintain the catalytic plug at a temperature above the control temperature without the necessity of electrical heating. With conventional diesels not requiring glow plugs once started, use of the catalytic plugs of this invention as a starting aid, allows cold starting of a cranking engine at ambient temperatures as low as 200K. Even with engine compression ratios below about 12 to 1, it may be possible to operate at idle without electrical heating after initial start-up, especially with an oxygenated fuel as for example methanol.

With conventional glow plugs, the high temperatures required for effective surface ignition of fuels not only impose a high power requirement but shorten glow plug life if the plugs are kept in continuous operation. Use of catalytic glow plugs in accordance with the present invention reduces power requirements in continuous operation by reducing the surface temperature required for ignition of fuels. Glow plugs with oxide ceramic ignition elements are advantageous because such plugs can better tolerate the very high temperature oxidizing conditions typical of full load operation. It is feasible to better insulate such a plug against heat loss, further minimizing the electrical power required at low load. With plugs of conventional materials it has been found necessary to allow sufficient heat loss to limit full load maximum temperature to an acceptable level, ie: about 1500 degrees Kelvin or less. Moreover, such conventional plugs having a relatively narrow operating temperature range impose severe design requirements on the temperature controller to avoid overheating of the plug should electrical heating requirement change abruptly as during a rapid engine acceleration. Glow plugs capable of igniting fuels at lower temperatures greatly simplify controller design and make it possible to assure that the plug temperature will not exceed allowable limits. Cooling fins on the plug body may be employed to limit maximum plug temperature by heat transfer to the ambient air.

The following examples describe the means of making and using the invention and set forth the best mode contemplated for carrying out the invention but are not to be construed as limiting.

EXAMPLE 1: To demonstrate the superiority of low ignition temperature catalytic glow plugs under adverse operating conditions, an NGK diesel glow plug was obtained and a thin non-porous coating of alumina applied by sputtering to the ignition surfaces. An aqueous solution containing chloroplatinic acid was then applied to the alumina surface and the plug heated electrically to activate the platinum. The coated plug was then compared to an uncoated NGK plug in a John Deere rotary engine in Deere's 20-1 test cell. Operating at 4800 RPM and 17 percent of full load power output, with the catalyst coated plug in the test rotor chamber the engine operated satisfactorily at plug temperatures as low as 1045 degrees Kelvin. With the conventional uncoated NGK glow plug in the test rotor chamber, the engine could not be operated as low as 17 percent power output even with the plug temperature at 1336 degrees Kelvin. With the engine operating at a higher power level with the uncoated plug at 1336 degrees Kelvin, reduction in the power setting resulted in combustion failure and engine shutdown.

EXAMPLE 2: To test the durability of catalyst coated conventional glow plugs, four Volkswagen (VW) diesel glow plugs were coated with a thin coating of zirconia (less than about 2 mils thick) and a major portion of the surface was then additionally solution coated with a platinum/alumina/zirconia catalyst composition. One of the glow plugs of a diesel Rabbit engine was then replaced with one of the catalytic plugs. After a several thousand miles the catlytic plug was removed for examination. The plug removed showed no visible signs of damage.

EXAMPLE 3: In accordance with the present invention, a four cylinder diesel engine of a VW Rabbit is modified by replacing the conventional glow plugs in the combustion chamber of each cylinder with catalytic glow plugs as used in the durability test just described in Example 2, and by changing the head gasket to lower the compression ratio below about 14/1. In operation of the engine the ignition catalyst surface of the plug is electrically heated to a temperature high enough to be effective for vaporization of diesel fuel and ignition of vaporized fuel. The electrical heating is applied as needed using a predictive controller to maintain the catalyst at a predetermined operating temperature at least about 150 degrees Kelvin lower than required for ignition of diesel fuel using a non-catalytic glow plug in the engine. Air is compressed in the combustion chamber and diesel fuel is injected in the normal manner at a time approximately three crank angle degrees later than recommended by VW. The fuel is ignited by contact with the heated catalyst with the resulting combustion resulting in a combustion wave in the vicinity of top dead center with minimal formation of soot.

What is claimed is:

1. A method for more rapid starting of an unthrottled internal combustion engine, which method comprises:

(a) electrically heating an ignition catalyst comprising at least an effective portion of the ignition surface of a glow plug to a temperature effective for vaporization and ignition said temperature being at least about 75 degrees Kelvin below that value required for ignition with a non-catalytic glow plug of the same size and configuration as said catalytic plug; and (b) igniting gas phase combustion of an admixture of fuel and air by contact of said admixture with said heated catalyst, said combustion resulting in a combustion wave in the immediate vicinity of top dead center.

2. A method for igniting fuel, which method comprises:

(a) electrically heating an ignition catalyst comprising at least an effective portion of the ignition surface of a glow plug to a temperature effective for vaporization and ignition of said fuel, said temperature being at least about 75 degrees Kelvin below that value required for ignition with a non-catalytic glow plug of the same size and configuration as said catalytic surface plug; and (b) igniting gas phase combustion of an admixture of said fuel and air by contact of said admixture with said heated catalyst.

* * * * *